US005170957A

United States Patent [19]

Carpenter

[11] Patent Number: 5,170,957

[45] Date of Patent: Dec. 15, 1992

[54] DISPENSER OF PLASTIC BAGS WITH HANDLES

[76] Inventor: Len Carpenter, 690 Grosvenor, Westmount, Quebec, Canada, H3Y 2T2

[21] Appl. No.: 753,819

[22] Filed: Sep. 3, 1991

[51] Int. Cl.[5] ..... B65H 23/00

[52] U.S. Cl. ..... 242/55.53; 221/33; 221/63; 206/409; 206/390

[58] Field of Search ..... 242/55.53; 206/554, 206/409, 390; 221/63, 33, 45

[56] References Cited

U.S. PATENT DOCUMENTS

| | | | |
|---|---|---|---|
| 2,640,587 | 10/1948 | Smith | 221/63 |
| 3,098,594 | 7/1963 | Williamson | 206/409 |
| 3,229,876 | 1/1966 | Osborn, Jr. | 206/554 |
| 3,576,243 | 4/1971 | Trunick | 221/63 |
| 3,826,361 | 7/1974 | Heckrodt | 206/409 |
| 4,191,307 | 3/1980 | LeCaire, Jr. et al. | 242/55.53 |
| 4,807,754 | 2/1989 | Rowe | 206/390 |
| 4,850,486 | 7/1989 | Neibaur | 206/390 |
| 5,024,349 | 6/1991 | Haenni et al. | 221/63 |

FOREIGN PATENT DOCUMENTS

| | | | |
|---|---|---|---|
| 1-226579 | 9/1989 | Japan | 221/63 |

*Primary Examiner*—Daniel P. Stodola
*Assistant Examiner*—John Q. Nguyen
*Attorney, Agent, or Firm*—Chilton, Alix & Van Kirk

[57] ABSTRACT

A roll of plastic bags sequentially disposed in end-to-end relationship, each bag having two spaced handles, separated by a gap, and extending upwardly along the edges at the top end of each bag, each bag being joined to a following bag by a perforated line, is disposed in a box-like dispenser having a front face. A dispensing opening in the front face has a first cut-out portion and a second, spaced cut-out portion with a tab extending upwardly between the cut-out portions. The tops of the cut-out portions, when joined together, define a bottom boundary overlying the cut-out portions and the tab. The top of the tab and the bottom boundary are separated by a gap which is substantially wider than the thickness of the plastic bag. Thus, when the bag is withdrawn, the handles of the next bag will fall into a respective one of the cut-out portions and lie outside of the dispenser so that the next bag is easily accessible for later dispensing.

5 Claims, 2 Drawing Sheets 101
100
13
17
23
21
7
19
11
15
7

100
13
101
23
17
21
1
15
7
19
11
7
101
100

13
23
21
19
15
7
11
1
7
7
3
7

DISPENSER OF PLASTIC BAGS WITH HANDLES

BACKGROUND OF THE INVENTION

1. Field of the Invention

The invention relates to a dispenser for rolls of plastic bags sequentially disposed in end-to-end relationship. More specifically, the invention relates to such a dispenser adapted to dispense plastic bags having two spaced handles, separated by a gap, and extending upwardly along the edges at the top end of each bag.

2. Description of Prior Art

Dispensers for plastic bags are known in the art as illustrated in, for example, U.S. Pat. No. 3,826,361, Heckrodt, Jul. 30, 1974, U.S. Pat. No. 4,191,307, LeCaire, Jr. et al, Mar. 4, 1980, U.S. Pat. No. 4,850,486, Neibaur, Jul. 25, 1989, and U.S. Pat. No. 3,098,594, Williamson, Jul. 23, 1963.

The '361, '307 and '486 patents all relate to dispensers for plastic bags, the dispensers having an opening either in one face or at the junction of two faces.

As seen in FIG. 4 of the '594 patent, the dispenser of this carton has a front face which includes two cut-out portions on either side of a tab 20. However, as seen at FIG. 2 of the '594 patent, the plastic bags which are dispensed by the dispenser 16 (see FIG. 3) do not include handles. As seen in FIGS. 4 and 5 of the patent, there is no gap between the top of the tab 20 and the cover 13. In fact, there is only a slit or cut which separates the top of the tab 20 from the cover 13. As seen in FIG. 6, the tab 37 actually overlies the tab 32. In FIG. 7, the tab 45 underlies the portion 41. A similar lack of gaps is seen that there is no gap between the top of the tab 20 and the cover 13.

In addition, the dispenser of the '594 patent would not operate if there were a gap between the top of the tab 20 and the cover 13. To understand why this is so, attention is directed to column 3, lines 18 et seq. of the patent wherein the operation of the dispensing container is described. In summary, the film F is drawn outwardly of the container until the cut or slit 24 of the film (see FIG. 2) overlies the tab 20. As stated at column 3, line 28 et seq. of the patent, "Continued withdrawal of the material will result in engagement of the arresting tab 20 within the cut or slit 24 . . . ". That is, the tab 20 has to engage the slit 24 between accomplished, it is of course necessary that there be some pressure on the top of the film, and there would not be any such pressure if there were a gap between the top of the tab 20 and the cover 13.

In any case, in all of the four above reference patents, there is no teaching of a dispenser which is especially adapted for dispensing plastic bags having two spaced handles, separated by a gap, and extending upwardly along the edges at the top end of each bag.

SUMMARY OF INVENTION

It is therefore an object of the invention to provide a dispenser adapted to dispense plastic bags having two spaced handles, separated by a gap, and extending upwardly along the edges beyond the top end of each bag.

It is a further object of the invention to provide a dispenser which will prevent the first bag of the roll adjacent the opening of the dispenser from falling back into the dispenser and being inaccessible from outside of the dispenser.

It is a still further object of the invention to provide such a dispenser having cut-out portions aligned with the handles of the bag whereby, when a bag will fall into the cut-out portions and be disposed outside of the dispenser so that the next bag is easily accessible from outside of the dispenser.

In accordance with a particular embodiment of the invention there is provided a dispenser for rolls of plastic bags sequentially disposed in end-to-end relationship, each said bag having two spaced handles, separated by a gap, and extending upwardly along the edges beyond the top end of each bag, each bag being joined to a following bag by a perforated line;

said dispenser comprising a box having a front face;

a dispensing opening in said front face;

said dispensing opening comprising a first cut-out portion and a second spaced cut-out portion;

a tab extending between said cut-out portions;

the tops of said cut-out portions, when joined together, defining a bottom boundary overlying said cut-out portions and said tab; and a gap between the top of said tab and said bottom boundary, said gap being substantially wider than the thickness of said plastic bags.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
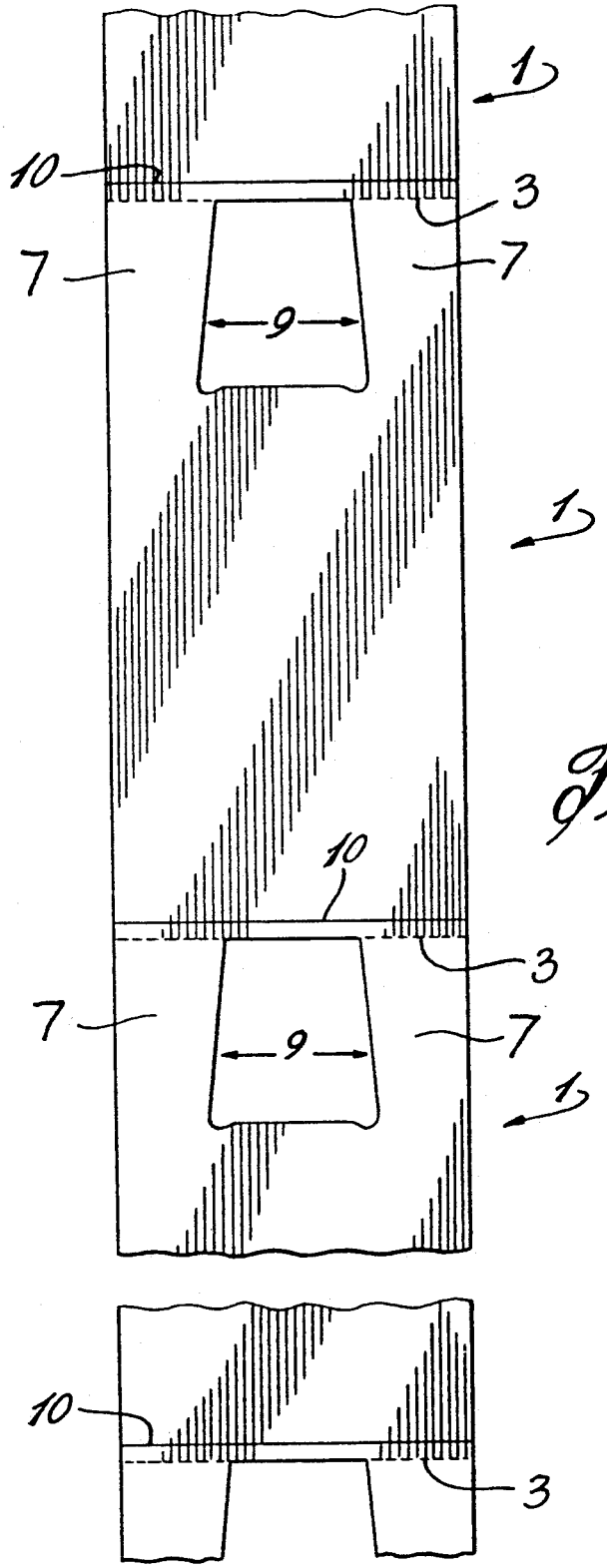
FIG. 1 illustrates plastic bags which the inventive dispenser is adapted to dispense.
Figures 2, 3, 4:
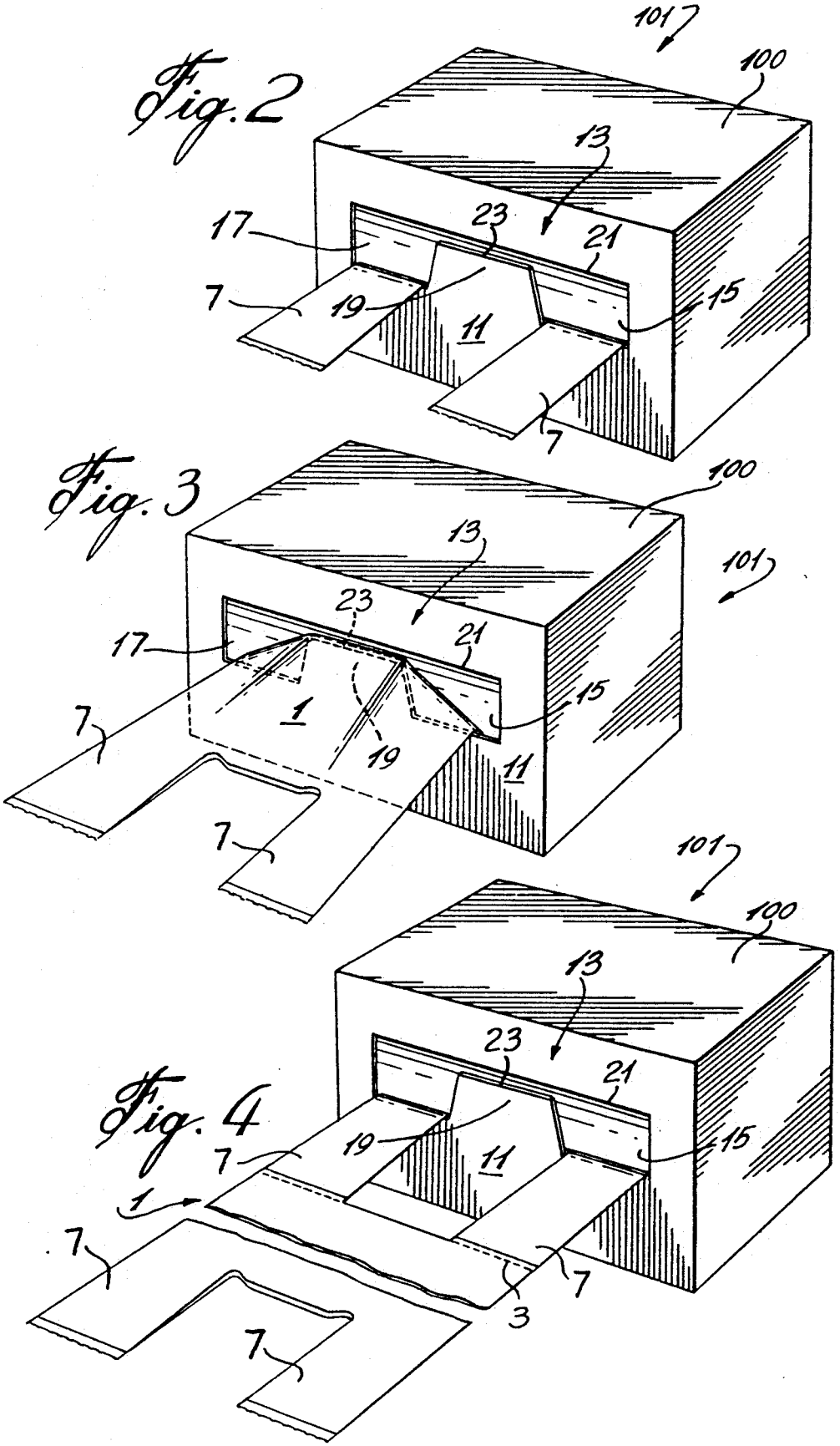
FIG. 2 is a perspective view of the inventive dispenser showing the disposition of the plastic bag next to be withdrawn from the dispenser.
FIG. 3 is a view similar to FIG. 1 but showing a bag partially withdrawn from the dispenser.
FIG. 4 is a view similar to FIGS. 2 and 3 showing a plastic bag completely withdrawn from the dispenser and ready to be severed from the following bag.

Referring to FIG. 1, the bags to be dispensed comprise a main body portion 1 having a top end which includes handles 7, which are separated by gap 9, and which extend upwardly at both edges of the bag beyond the top end of each bag. Perforated line 9 connects the bottom end of one bag to the top end of the next bag bags so that the are easily removable from each other, and 10 constitutes a seal for sealing the bottom end of each bag. Referring to FIGS. 2, 3 and 4, the dispenser, indicated generally at 100, is box-like in shape and includes a front face 11. A dispensing opening, referenced generally at 13, is included in the front face. The opening 13 includes two cut-out portions 15 and 17, and a tab 19 extends between and separates the cut-out portions. The tops of the cut-out portions, when joined together, define a bottom boundary 21 which overlies the top 23 of the tab 19. As can be seen, there is a substantial gap between the bottom boundary 21 and the top 23 of the tab 19. This gap is at least wider than the thickness of the bag so that a bag can be easily withdrawn from the dispenser through the gap without any pressure being applied to the bag by the action of the lower boundary 21 and the top 23 of the tab 19.

As seen in FIG. 2, the next bag to be dispensed has its handles 7 disposed in respective ones of the cut-out portions 15 and 17 with the handles lying outside of the dispenser. Accordingly, the next bag can be easily accessed and will not fall back into the dispenser.

In order to remove a bag from the dispenser, the handles 7 are lifted upwardly to guide the bag through the gap between the lower boundary 21 and the top 23. The bag is then withdrawn. A bag partially withdrawn is illustrated in FIG. 3.

As the bag continues to be withdrawn, the gap 9 of the following bag will overlie the tab 19 so that the bag will fall downwardly with the handles 7 in respective ones of the cut-out openings 15 and 17. This is the position as illustrated in FIG. 4.

The fully withdrawn bag will then be separated from the next bag which will assume the position illustrated in FIG. 2, i.e., the handles 7 will lie outside of the dispenser so that the next bag to be withdrawn can be easily accessed.

The dispenser is preferably made of a cardboard material or the like, as is well known in the art, and an opening, preferably a closeable opening such as cover 100, is provided to permit insertion of a roll of plastic bags into the box. This is also well known Preferably, the cut-outs 15 and 17 are each of a width which is somewhat larger than the width of each less than the width of the gap 9 of the plastic bags. The width of the opening 13 is substantially the same size as the width of the bags to be dispensed.

Although a particular embodiment has been described, this was for the purpose of illustrating, but not limiting, the invention. Various modifications, which will come readily to the mind of one skilled in the art, are within the scope of the invention as defined in the appended claims.

I claim:

1. In combination, a dispenser and plastic bags in roll form, said plastic bags being sequentially disposed in end-to-end relationship in said dispenser for dispensing therefrom, each said bag having a first end and a second end, and having two spaced handles, separated by a gap, at said first end of each bag, each of said spaced handles extending along each side edge of each bag, the inner edges of the handles being joined by a gap end, each bag being joined to a following bag by a perforated line;

said dispenser comprising a box having a front face;

a dispensing opening in said front face;

said dispensing opening comprising a first cut-out portion and a second spaced cut-out portion, each said cut-out portion having a top edge;

a tab extending between said cut-out portions towards said top edge;

the top edges of said cut-out portions being joined together and defining an upper boundary overlying said cut-out portions and said tab; and a dispensing gap between the top of said tab and said upper boundary, said dispensing gap being narrower than the height of each cut-out portion, said dispensing gap being substantially wider than the thickness of said plastic bags;

wherein, said bas are withdrawn through said opening one at a time with said first end of each bag being withdrawn through the opening first; and wherein, when said bags are withdrawn through said opening, because the width of said dispensing gap is substantially wider than the thickness of said bags, said bas flow through said dispensing gap without obstruction and without being supported by said tab; and wherein, when a first bag is withdrawn to its perforated line, the handles of the following second bag fall into said cut-out portions such that one handle lies in said first cut-out portion and the other handle lies in said second cut-out portion; and wherein upon further withdrawal of said first bag, the gap end of the second bag abuts said tab so that the bags can no further be withdrawn; and whereupon, said first bag is separated from said second bag and each of the handles of said second bag extend through a respective one of said cut-out portions so that said second bag can be easily accessed, by grasping said handles, for withdrawal through said dispensing opening.

2. A dispenser as defined in claim 1 wherein the width of each said cut-out portions is greater than the width of each of said handles.

3. A dispenser as defined in claim 2 wherein the width of said tab is smaller than the width of said gap.

4. A dispenser as defined in claim 3 wherein the width of said dispensing opening is larger than the width of each of said bags.

5. A dispenser as defined in any one of claims 1, 2, 3 or 4 wherein said box is made of a cardboard material.

* * * * *